US005236235A

United States Patent [19]

Gustafson et al.

[11] Patent Number: 5,236,235

[45] Date of Patent: Aug. 17, 1993

[54] CONCEALED SCREW ROSE MOUNTING SYSTEM

[75] Inventors: Ronald E. Gustafson; Robert J. Hartzell, both of Jamestown; Robert J. Carlson, Stowe, all of N.Y.; Dale L. Flowerday, Holland, Mich.

[73] Assignee: Chautauqua Hardware Company, Jamestown, N.Y.

[21] Appl. No.: 905,920

[22] Filed: Jun. 29, 1992

[51] Int. Cl.[5] ..... E05B 3/00

[52] U.S. Cl. ..... 292/357

[58] Field of Search ..... 292/347, 350, 351, 356, 292/357; 411/178, 407

[56] References Cited

U.S. PATENT DOCUMENTS

| | | | |
|---|---|---|---|
| 90,209 | 5/1869 | Waterman et al. | 292/357 |
| 109,409 | 11/1870 | Henderson | 292/357 |
| 126,642 | 5/1872 | Mattson . | |
| 130,131 | 8/1874 | Hood . | |
| 152,999 | 7/1874 | Kedey | 292/357 |
| 435,250 | 8/1890 | Sampson | 292/357 |
| 1,293,865 | 2/1919 | Mueller | 411/405 X |
| 1,934,347 | 11/1933 | Flesselles | 411/407 |
| 3,471,190 | 10/1969 | Wansbrough et al. | 292/356 |
| 4,037,865 | 7/1977 | Hook | 292/357 |
| 4,067,599 | 1/1978 | Ohno | 292/356 X |
| 4,067,599 | 1/1978 | Ohno | 292/357 |
| 4,877,278 | 10/1989 | Valley | 292/357 X |
| 4,998,701 | 3/1991 | Rawald | 248/224.3 |

*Primary Examiner*—Richard E. Moore

*Attorney, Agent, or Firm*—Varnum, Riddering, Schmidt & Howlett

[57] ABSTRACT

A rose retaining system comprising a mounting plate, rose, rose mounting screw and washer. The mounting plate is mounted to the door by screws passing through holes in the mounting plate. The rose plate is mounted to the mounting plate by the rose mounting screw. The rose mounting screw has a externally threaded tubular portion which passes through the center of the rose and is threaded into the internally threaded tubular projection of the mounting plate. The rose mounting screw is threaded until the slotted collar contacts the recessed shoulder of the rose plate. The key is then used to tightened the rose mounting screw, securing the rose plate in the desired position. The key can be used whether or not the spindle is mounted through the axially aligned openings of the mounting plate, rose and rose mounting screw. After mounting is completed, the exterior surface of the collar of the rose mounting screw is recessed below the outer surface of the rose mounting plate. A washer is inserted onto the outer surface of the rose mounting screw concealing the rose mounting screw. A door knob or door handle is then mounted to the end of the spindle passing through the axially aligned holes with the shank of the door knob or door handle resting against the washer, effectively concealing the rose mounting screw from view.

10 Claims, 5 Drawing Sheets

CONCEALED SCREW ROSE MOUNTING SYSTEM

BACKGROUND OF THE INVENTION

1. Field of the Invention

This invention relates to a rose mounting system; more specifically, to a rose mounting system providing for a concealed screw application, while ensuring the proper positioning of the rose for a wide variety of rose designs.

2. Description of the Related Art

A rose in door hardware is a decorative plate which is mounted on the door at a knob or handle to conceal the mounting hardware and the hole in the door. Rose retaining systems are normally used in combination with several types of door knobs and latches. The rose retaining system provides for the mounting of a decorative rose to the exterior surfaces of the door, hiding from view the latch mechanism and any holes drilled in the door as required for the operation of the latch. Typically, the latch is mounted internally to a door. A spindle is passed through the door and latch. An adaptor plate, rose and rose retainer is slidably mounted onto the spindle. The adaptor plate is mounted to the door, and the rose is mounted to the adaptor plate by the rose retainer. The door knob is mounted to the end of the spindle.

The Henderson, U.S. Pat. No. 109,409, and Kedey U.S. Pat. No. 152,999, disclose a rose mounting system where an adaptor plate is mounted to a door or other surface by screws passing through the base of the adaptor plate. The adaptor plate has an internally threaded bushing extending outwardly from the adapter plate outer surface. The rose plate is positioned over the adaptor plate so that the hole in the center of the rose plate aligns axially with the hole through the center of the threaded bushing. An externally threaded rose retainer is then inserted through the hole of the rose plate and screwed into the internally threaded bushing until the collar of the rose retainer contacts the outer surface of the rose plate. The rose retainer is then tightened to fix the rose plate in its proper position. However, the rose retainer is visible after it is assembled which detracts from the aesthetic appearance of the rose hardware.

The Hood, U.S. Pat. No. 130,131, discloses a rose retaining system wherein an externally threaded rose retainer or nut threads into an axillary nut which is threaded directly into the door and received in a recess in the rose. The rose retainer has a flange at one end with screwdriver slots on the flange for tightening the nut.

The Waterman, et. al. U.S. Pat. No. 90,209, discloses a rose retaining system wherein an internally threaded rose retainer or screw threads onto an externally threaded tubular male screw attached to a mounting plate on one side of the door and the rose retainer is received in a recess in the rose on the other side of the door. The rose retainer has screwdriver slots on a flange of the rose retainer.

SUMMARY OF THE INVENTION

The invention is an improved rose mounting system for mounting a rose plate having an axial opening to a door in which a mounting plate having an axial opening is mounted to the door and also has a threaded tubular projection. A screw having an axial opening is threadably connected to the tubular extension and has a collar which retains the rose plate to the door. A spindle can extend out of the surface of the door and through the aligned axial openings of the mounting plate, rose and screw. A shoulder in the opening of the rose is recessed beneath the outer surface of the rose, and the collar on the screw is sized to fit within the rose opening and seat on the shoulder of the rose so that the screw, when seated, lies beneath the outer surface of the rose when it is threadably connected to the tubular extension.

The tubular extension can be either externally or internally threaded and the screw can be internally or externally threaded, respectively. Preferably, the screw has slots in the outer surface of the collar. A key is preferably provided to screw and unscrew the screw on and from the tubular extension. The key has at one end an arcuate flange flanked by two slot engaging shoulders which are adapted to fit within slots in the screw when the arcuate flange is inserted within the axial opening of the screw. The key has at its other end an arcuate cutout flanked by two flanges which are adapted to fit within the slots in the screw. Preferably, the two flanges in the key are bent laterally so that the flanges fit within the slots when the spindle extends through the openings of the rose and screw. Desirably, the arcuate flange and shoulders at one end of the key are complementary to the flanges and arcuate cutout at the other end of the key so that multiple keys can be stamped from flat metal stock of the width of the key without any scrap.

Typically, a door knob or door handle is mounted on a spindle which is received within the opening in the rose above the screw to conceal the screw within the rose.

In a preferred embodiment of the invention, a washer having a diameter smaller than the diameter of the opening of the rose above the shoulder is positioned between the screw and a handle mounted to the spindle.

BRIEF DESCRIPTION OF THE DRAWINGS

The invention will now be described with reference to the drawings in which.

DETAILED DESCRIPTION OF THE PREFERRED EMBODIMENTS

Figure 1:
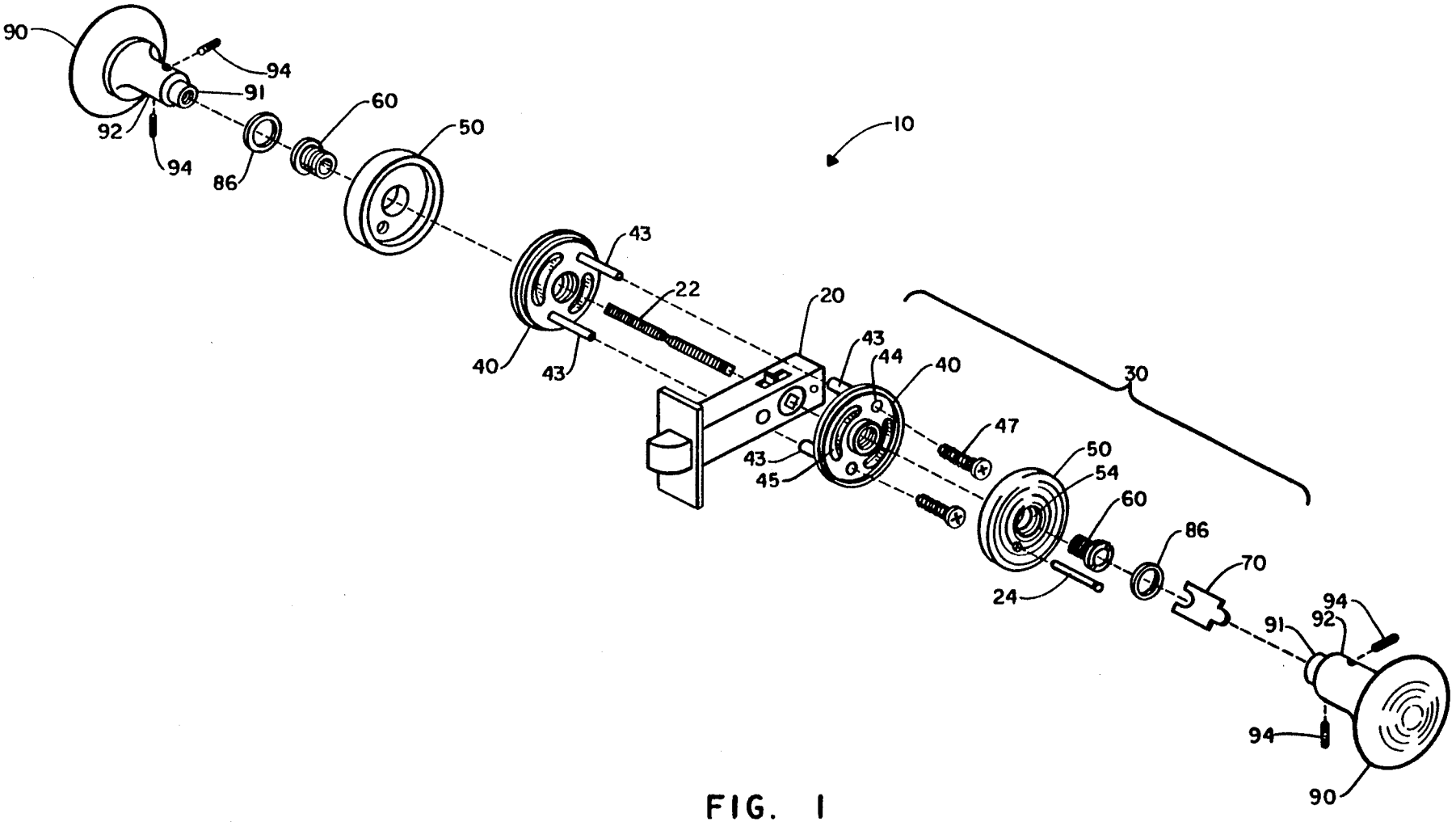
FIG. 1 is an exploded view of a complete predrilled door, privacy application which has a concealed screw rose mounting system according to the invention.

Referring to the drawings and specifically to FIG. 1, there is shown a pre-drilled door, privacy application 10 incorporating the concealed screw rose mounting system 30 according to the invention. The predrilled door, privacy application 10 comprises privacy latch 20, swivel spindle 22, concealed screw rose mounting system 30, washer 86, door knob 90 and set screws 94. The concealed screw rose mounting system 30 further comprises mounting plate 40, rose 50, rose mounting screw 60 and key 70.

Figure 2:
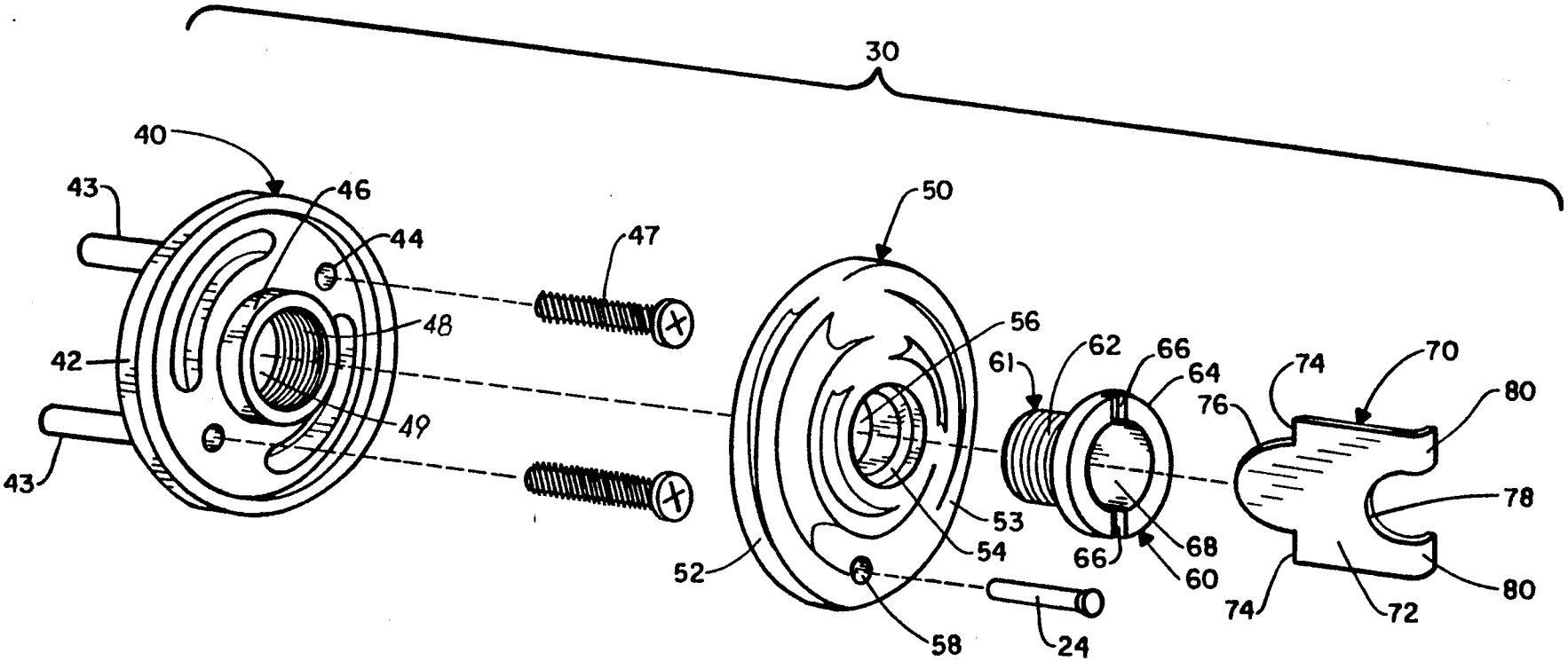
FIG. 2 is an exploded view of the concealed screw rose mounting system of FIG. 1.

Referring to FIGS. 1 and 2, the mounting plate 40 comprises a base 42 and tubular projection 46. The base 42 has screw guides 43, holes 44 and slots 45. The tubular projection 46 has internal threads 48 which define the annular opening 49 passing through the center of the mounting plate 40. The mounting plate 40 can have different shapes depending on the latch used and the particular application.

The rose 50 comprises a base portion 52, outer surface 53 and recessed shoulder 54. The shoulder 54 is recessed below the outer surface 53 of the rose 50. The rose 50 has an annular opening 56 which is defined by the internal edge of the shoulder 54. If a privacy application is used, the rose mounting system 30 will have a privacy button 24.

The rose mounting screw 60 is comprised of a tubular extension 61 and a collar 64. The tubular extension 61 has external threads 62. The collar 64 is provided with slots 66. An annular opening 68 is defined by the inner surfaces of the tubular extension 61 and collar 64 of the rose mounting screw 60.

The key 70 is comprised of a base portion 72, arcuate flange 76 and curved flanges 80. The base portion 72 has shoulders 74 from which the arcuate flange 76 extends outwardly. The curved flanges 80 form an arcuate cutout 78 which is complementary in shape to the arcuate flange 76 when the curved flanges 80 are straightened.

Because the arcuate flange 76 is complementary with the arcuate cutout 78, several keys 70 can be stamped simultaneously or sequentially from a piece of metal the same width as the key without any waste. After the key is stamped, the curved flanges 80 are bent to the desired shape.

Figure 6:
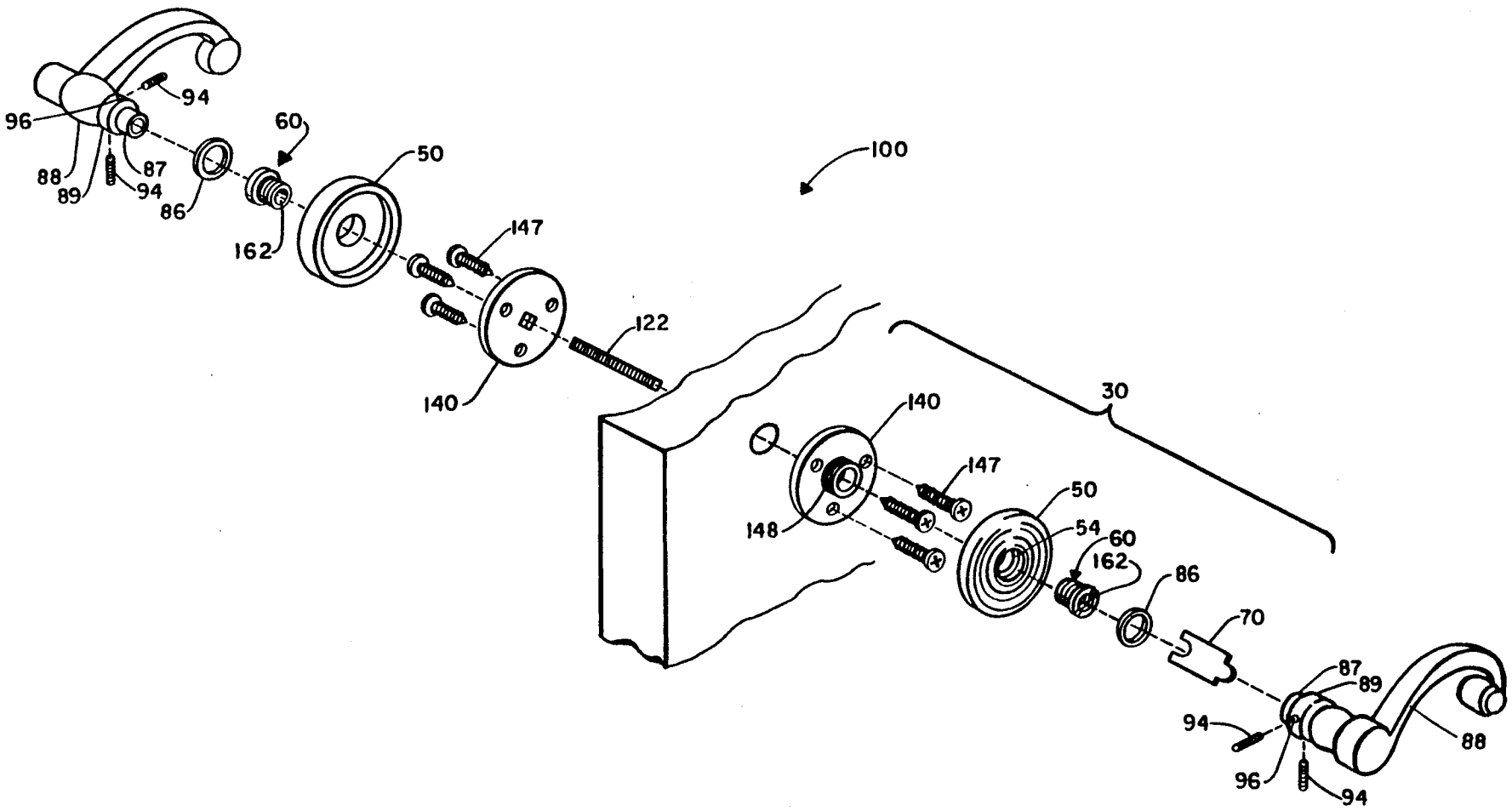
FIG. 6 is an exploded view of an alternate embodiment of the concealed screw rose mounting system.

Referring to FIGS. 1 and 6, the door handle 88 or door knob 90 both have a shank 87, 91 and stem 89, 92, respectively. Set screws 94 are threaded into holes 96 located on the stems 89, 92.

Figure 3:
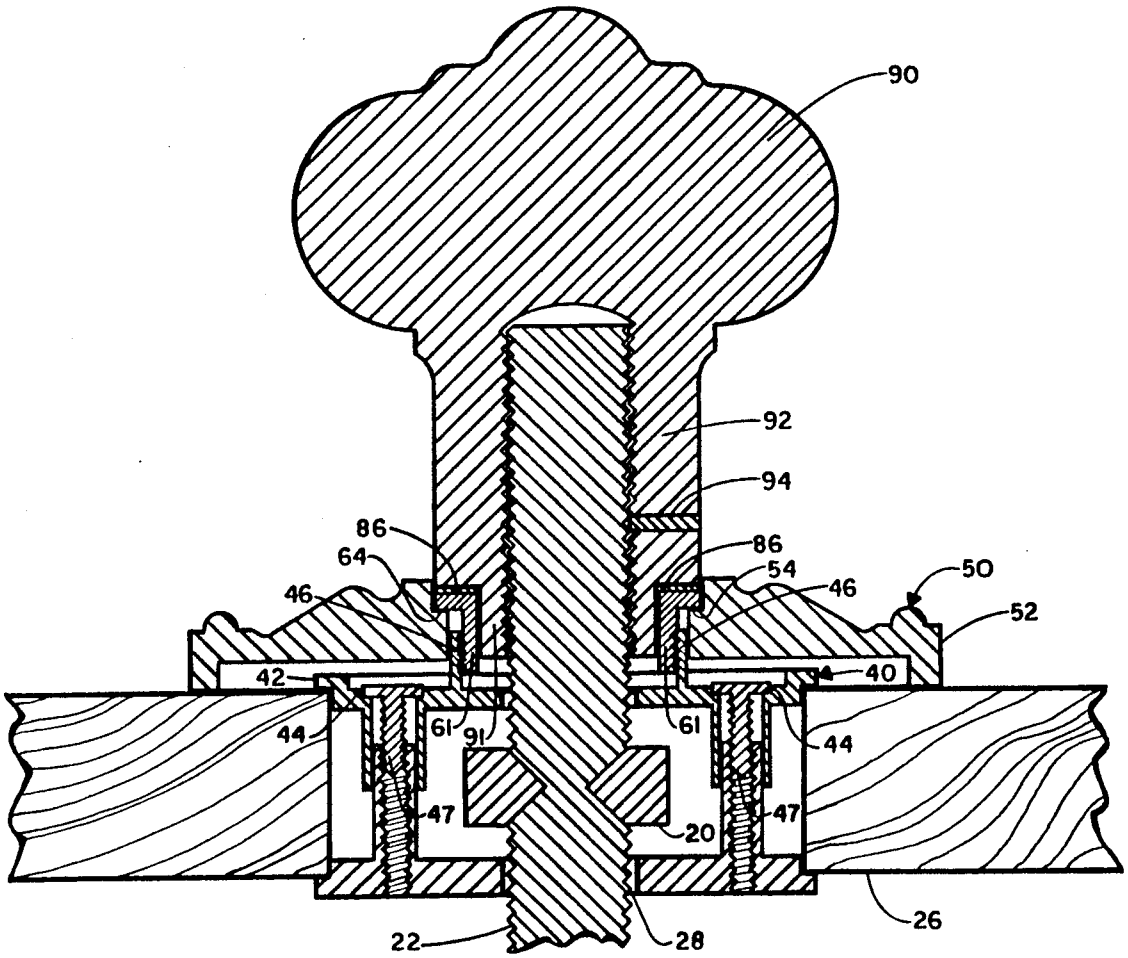
FIG. 3 is a sectional view of the concealed screw rose mounting system of FIG. 2 when assembled.

Referring to FIG. 3, the concealed screw rose mounting system according to the invention is shown assembled along with the washer 86, door knob 90 and swivel spindle 22. To assemble the rose mounting system 30, the mounting plate 40 is mounted to the door surface 26 by screws 47 passing through the holes 44 and into the screw guides 43 in the base 42 of the mounting plate 40. The mounting plate 40 is positioned so that the annular opening 49 axially aligns with the hole 28 in the door surface 26 which provides for passage of the spindle through the door surface 26. Preferably, the screw guides 43 of one of the mounting plates 40 are longer and of smaller diameter than the screw guides of the other mounting plate 40, providing for insertion of the screw guides of one plate into the screw guides of the other plate, aiding in the alignment of the screw guides. The longer and smaller diameter screw guides 43 are preferably threaded.

The rose 50 is placed over the mounting plate 40 so that the axis of the annular opening 56 aligns with the axis of the annular opening 49 of the mounting plate 40. If a privacy button 24 is used for locking the latch, then the rose 50 will have a corresponding privacy button hole 58. The rose 50 is rotated until the privacy button hole 58 aligns with a corresponding hole in the door (not shown). The tubular extension 61 of the rose mounting screw 60 is then inserted through the annular opening 56 of the rose 50 and threaded into the annular opening 49 of the mounting plate 40. The rose mounting screw 60 is tightened until the collar 64 contacts the shoulder 54 of the rose 50. The key 70 is used to snug the collar 64 of the rose mounting screw 60 against the shoulder 54 of the rose 50. The arcuate flange 76 fits snugly into the opening in the screw 60 to guide the shoulders 74 into place in the slots 66. The key has a width slightly less than the diameter of rose opening outwardly of the recessed shoulder 54. After the rose mounting screw 60 is snugged, the collar 64 will lie below the outer surface 53 of the rose 50.

The washer 86 is then disposed over the outer surface of the collar 64. The rose mounting screw 60 is recessed a sufficient distance below the outer surface 53 of the rose 50 so that the washer 86 is either flush or recessed with respect to the outer surface 53 of the rose 50. The shank 87, 91 of the door handle 88 or the door knob 90, respectively, is inserted into the annular opening 68 of the rose mounting screw 60. The shank 87, 91 is threaded onto the end swivel spindle 22. The stem 89, 92 of the door knob 90 or handle 88 is fastened to the swivel spindle 22 by set screws 94 which pass through holes 96 in stems 89 and 92 of the knob 90 or handle 88 and abut against the surface of the swivel spindle 22. With the rose mounting screw 60 recessed below the outer surface of the rose, the rose mounting screw is not visible after the washer 86 and door handle 88 or door knob 90 are mounted to the swivel spindle 22, providing for a significantly more pleasing aesthetic appearance than prior rose mounting systems.

Figure 4:
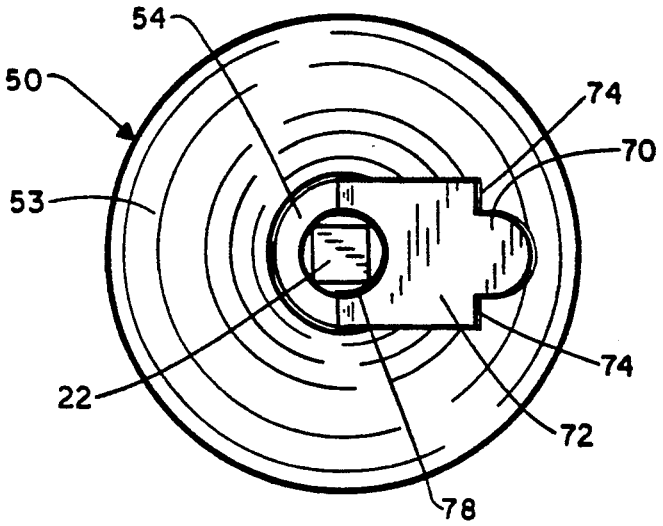
FIG. 4 is a left end view of the assembled concealed screw rose mounting system of FIG. 3, illustrating one use of a key according to the invention.
Figure 5:
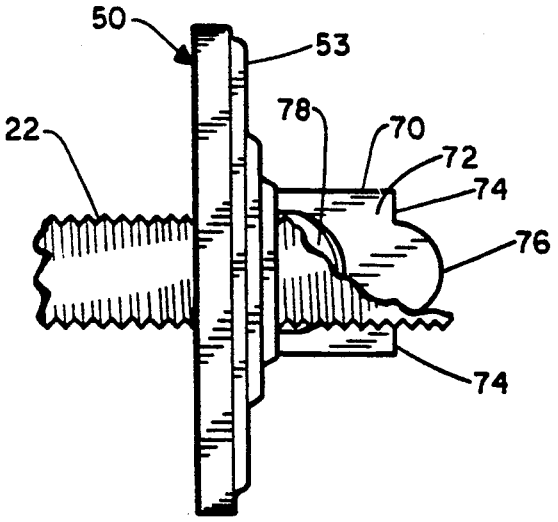
FIG. 5 is a side view of the assembled concealed screw rose mounting system and key shown in FIG. 4 and of FIG. 3.

Referring now to FIGS. 4 and 5, the key 70 can be used whether or not the swivel spindle 22 is in place such as during mounting or adjustment of the rose. If the swivel spindle 22 is not in place, the arcuate flange 76 of the key 70 is inserted into the annular opening 68 of the rose mounting screw and the shoulder 74 of the key 70 are pressed into the corresponding slots 66 of the rose mounting screw 60, and the key is rotated causing the collar 64 to snug against the shoulder 54 of the rose 50. If the swivel spindle 22 is already inserted through the aligned annular openings of the mounting plate 40, rose 50 and rose mounting screws 60, respectively, then the curved flanges 80 of the key 70 are inserted into the corresponding slots 66 of the rose mounting screw and the key 70 is rotated to tighten the collar 64 snugly against the shoulder 54 arcuate cutout 78 of the key 70 provides for the rotation of the key 70 while the swivel spindle 22 extends through the axially aligned annular openings 49, 56, 68 of the mounting plate 40, rose 50 and rose mounting screw 60, respectively.

After the concealed rose mounting system 30 is completely assembled, the position of the mounting plate 40 can be adjusted simply by removing or backing up the handle 88 or knob 90 a sufficient distance so that the curved flanges 80 of the key 70 can be positioned within the slots 66 of the rose mounting screw 60. It is not necessary to completely disassemble the pre-drilled door, privacy application 10 or rose mounting system 30 in order to gain access to the rose mounting screw 60 for adjusting the position of the rose 50, providing for ease of adjustment unknown in prior rose mounting systems.

The non-drilled door, dummy application 100 shown in FIG. 6 is an alternate embodiment of the concealed screw rose mounting system 30. Like numerals are used to describe like parts. The non-drilled door, dummy application 100 is very similar to the pre-drilled door, privacy application 10. The non-drilled door, dummy application uses a similar mounting plate 140, rose 50, rose mounting screw 60 and key 70. The main difference between the non-drilled door, dummy application 100 and pre-drilled door, privacy application 10 is that the mounting plate 140 of the non-drilled door, dummy application has external threads 148 instead of internal threads 48, and the rose mounting screw 60 has internal threads 162 instead of external threads 62. Further, the dummy mounting plate 140 does not have slots 43 because the privacy button 24 is not necessary for a dummy application. The dummy application 140 uses screws 147 instead of screws 47 to screw the mounting plates 140 to the door instead of screwing the mounting plates 140 together. Last, the dummy application 100 uses a solid spindle 122 instead of a swivel spindle 22.

There are several other well known applications in which the concealed screw rose mounting system can be used. The different applications include, but are not limited to: pre-drilled door, passage application, non-drilled door, privacy application, and non-drilled door, passage application. The passage applications do not have a lock or privacy button as do the pre-drilled door, privacy applications. The pre-drilled door applications have a different mounting plate than the non-drilled door applications.

Reasonable variation and modification are possible within the scope of the foregoing specification and drawings without departing from the spirit of the invention.

The embodiments for which an exclusive property or privilege is claimed as defined as follows:

1. An improved rose mounting system for mounting a rose to a door having opposed exterior surfaces in which a mounting plate having an axial opening is mounted to one of the exterior surfaces of the door, the mounting plate further having an integral threaded tubular projection extending outwardly from the one exterior door surface, and a screw also having an axial opening is threadably connected to the tubular projection and has a collar which retains the rose onto the door, a spindle extends out of the surface of the door and through the aligned openings of the mounting plate, rose and screw, the improvement comprising:

the axial opening of the rose has a recessed shoulder beneath the outer surface of the rose, and the collar on the screw is sized to fit within the rose opening and seat on the shoulder of the rose so that the screw is seated beneath the outer surface of the rose.

2. The improved rose mounting system according to claim 1 wherein the tubular projection is externally threaded and the screw is internally threaded.

3. The improved rose mounting system according to claim 1 wherein the tubular projection is internally threaded and the screw is externally threaded.

4. The improved rose mounting system according to claim 1 wherein the screw has slots in the outer surface of the collar.

5. The improved rose mounting system according to claim 4 and further comprising a key for turning the screw, the key has at one end an arcuate flange flanked by two slot engaging shoulders which are adapted to fit within slots in the screw when the arcuate flange is within the axial opening in the screw.

6. The improved rose mounting system according to claim 5 wherein the key has at the other end an arcuate cutout flanked by two flanges which are adapted to fit within slots in the screw.

7. The improved rose mounting system according to claim 6 wherein the two flanges in the key are bent laterally so that the flanges fit within the slots when the spindle extends through the rose opening and the screw.

8. The improved rose mounting system according to claim 6 wherein the arcuate flange and shoulders at one end of key are complementary to the flanges and the arcuate cutout at the other end of key so that multiple keys can be stamped from flat metal stock of the width of the key without scrap.

9. The improved rose mounting system according to claim 1 further comprising a handle or knob having a stem which is received within the opening in the rose above the screw to conceal the screw within the rose.

10. The improved rose mounting system according to claim 9 further comprising a washer having a diameter smaller than the diameter of the opening of the rose above the shoulder thereof and positioned between the screw and the stem.

* * * * *